US010480871B2

(12) United States Patent
Mueller et al.

(10) Patent No.: US 10,480,871 B2
(45) Date of Patent: Nov. 19, 2019

(54) HEAT EXCHANGER FLANGE PLATE WITH SUPERCOOLING FUNCTION

(71) Applicant: MODINE MANUFACTURING COMPANY, Racine, WI (US)

(72) Inventors: Tobias Mueller, Aichtal (DE); Stefan Mueller-Lufft, Leonberg (DE)

(73) Assignee: MODINE MANUFACTURING COMPANY, Racine, WI (US)

( * ) Notice: Subject to any disclaimer, the term of this patent is extended or adjusted under 35 U.S.C. 154(b) by 0 days.

(21) Appl. No.: 16/099,905

(22) PCT Filed: Jun. 9, 2017

(86) PCT No.: PCT/US2017/036696

§ 371 (c)(1),
(2) Date: Nov. 8, 2018

(87) PCT Pub. No.: WO2017/214478

PCT Pub. Date: Dec. 14, 2017

(65) Prior Publication Data

US 2019/0154366 A1 May 23, 2019

(30) Foreign Application Priority Data

Jun. 10, 2016 (DE) ..... 10 2016 007 089

(51) Int. Cl.
*F28F 9/02* (2006.01)
*F28D 9/00* (2006.01)
(Continued)

(52) U.S. Cl.
CPC ..... *F28F 9/0253* (2013.01); *F28D 1/00* (2013.01); *F28D 1/03* (2013.01); *F28D 1/035* (2013.01);
(Continued)

(58) Field of Classification Search
CPC ..... F28F 3/00; F28F 3/005; F28F 3/02; F28F 3/12; F28F 3/083; F28F 9/0253;
(Continued)

(56) References Cited

U.S. PATENT DOCUMENTS 4,423,708 A 1/1984 Sweetland
5,896,834 A * 4/1999 Gruner ..... F28D 9/005 123/196 AB
(Continued)

FOREIGN PATENT DOCUMENTS

AT 506972 A4 * 1/2010 ..... F28D 9/005
CA 2925508 A1 * 4/2015 ..... F28F 9/0248
(Continued)

OTHER PUBLICATIONS

International Search Report and Written Opinion for Application No. PCT/US2017/036696 dated Aug. 21, 2017 (9 pages).

*Primary Examiner* — Cassey D Bauer
*Assistant Examiner* — Jenna M Hopkins
(74) *Attorney, Agent, or Firm* — Michael Best & Friedrich LLP; Jeroen Valensa; Michael Bergnach

(57) ABSTRACT

A heat exchanger having a heat exchanger core which is configured as a plate stack has a flange plate including at least one upper partial plate facing the heat exchanger core and at least one lower partial plate facing away from the heat exchanger core. The flange plate can include a supercooling passage which is bounded by at least one partial plate in the stacking direction of the partial plates and which receives a flow of refrigerant during the operation of the heat exchanger. A high variability can be provided thanks to the compact and flexible design, by means of which the most diverse of requirements can be achieved with no major design changes.

15 Claims, 4 Drawing Sheets

(51) Int. Cl.

| | |
|---|---|
| ***F28D 21/00*** | (2006.01) |
| ***F28D 1/03*** | (2006.01) |
| ***F28D 1/00*** | (2006.01) |
| ***F28F 3/00*** | (2006.01) |
| ***F28F 3/08*** | (2006.01) |
| ***F28D 5/00*** | (2006.01) |
| ***F28F 3/12*** | (2006.01) |
| ***F28F 3/02*** | (2006.01) |

(52) U.S. Cl.
CPC ..... *F28D 1/0308* (2013.01); *F28D 1/0341* (2013.01); *F28D 5/00* (2013.01); *F28D 9/00* (2013.01); *F28D 9/005* (2013.01); *F28D 9/0031* (2013.01); *F28D 9/0081* (2013.01); *F28F 3/00* (2013.01); *F28F 3/005* (2013.01); *F28F 3/02* (2013.01); *F28F 3/083* (2013.01); *F28F 3/12* (2013.01); *F28F 9/02* (2013.01); *F28D 2021/008* (2013.01); *F28D 2021/0063* (2013.01); *F28F 2009/0287* (2013.01); *F28F 2280/06* (2013.01)

(58) Field of Classification Search
CPC ..... F28F 9/02; F28F 9/0081; F28F 9/0031; F28F 9/00; F28F 9/0037; F28F 2009/0287; F28F 2280/06; F28F 9/0075; F28D 1/00; F28D 1/03; F28D 1/0308; F28D 1/0341; F28D 1/035; F28D 9/0081; F28D 9/00; F28D 5/00; F28D 2021/008; F28D 2021/0091; F28D 2021/0092; F28D 2021/0094; F28D 9/0031; F28D 9/0037
See application file for complete search history.

(56) References Cited

U.S. PATENT DOCUMENTS

| | | | | |
|---|---|---|---|---|
| RE45,853 | E * | 1/2016 | Neal | F01M 5/00 |
| 9,797,665 | B2 * | 10/2017 | Muller-Lufft | F01M 5/002 |
| 9,933,215 | B2 * | 4/2018 | Ollier | F28F 9/00 |
| 2001/0054501 | A1 * | 12/2001 | Wehrmann | F28D 9/005 165/167 |
| 2006/0237184 | A1 * | 10/2006 | Peric | F16K 15/144 165/283 |
| 2007/0084809 | A1 * | 4/2007 | Bradu | F28D 9/005 211/59.4 |
| 2007/0261832 | A1 | 11/2007 | Ware | |
| 2008/0023190 | A1 | 1/2008 | Peric | |
| 2010/0206516 | A1 * | 8/2010 | Muller-Lufft | F01M 5/002 165/96 |
| 2012/0061060 | A1 * | 3/2012 | Stoll | F01M 5/002 165/133 |
| 2012/0152506 | A1 | 6/2012 | Otahal | |
| 2012/0170222 | A1 * | 7/2012 | Dede | F28F 3/083 361/702 |
| 2013/0319634 | A1 * | 12/2013 | Sheppard | F28F 27/00 165/96 |
| 2014/0224455 | A1 | 8/2014 | Kalbacher et al. | |
| 2015/0129164 | A1 * | 5/2015 | Ollier | F28F 9/00 165/67 |
| 2015/0276320 | A1 * | 10/2015 | Mueller | F28D 9/0093 165/166 |
| 2016/0161192 | A1 * | 6/2016 | Kim | F25B 40/00 165/167 |
| 2016/0215664 | A1 * | 7/2016 | Boyer | F01M 5/005 |
| 2016/0320141 | A1 * | 11/2016 | Barfknecht | F28D 9/0093 |
| 2016/0327318 | A1 * | 11/2016 | Kim | F25B 40/00 |
| 2016/0375740 | A1 * | 12/2016 | Duerr | B60H 1/00342 62/506 |
| 2018/0274406 | A1 * | 9/2018 | Dries | F28D 9/005 |

FOREIGN PATENT DOCUMENTS

| | | | | |
|---|---|---|---|---|
| CA | 2961642 | A1 * | 4/2016 | B23K 35/0233 |
| DE | 3248395 | A1 * | 7/1983 | F01P 11/08 |
| DE | 19654362 | A1 * | 6/1998 | F28D 9/005 |
| DE | 102009022919 | A1 * | 12/2010 | F01M 5/002 |
| DE | 202012007775 | U1 * | 10/2012 | F28F 9/00 |
| DE | 102016214122 | A1 * | 2/2017 | |
| EP | 1411311 | A1 * | 4/2004 | F28D 9/005 |
| EP | 2420763 | A2 | 2/2012 | |
| FR | 3045803 | A1 * | 6/2017 | F28F 3/08 |
| WO | WO-2009059678 | A1 * | 5/2009 | F01M 5/002 |
| WO | WO-2010136108 | A2 * | 12/2010 | F01M 5/002 |
| WO | WO-2012061928 | A1 * | 5/2012 | B23K 1/0012 |
| WO | WO-2014064334 | A1 * | 5/2014 | F28F 21/04 |
| WO | WO-2014090503 | A1 * | 6/2014 | F28F 9/26 |
| WO | WO-2015032988 | A1 * | 3/2015 | F25B 41/062 |
| WO | WO-2017012495 | A1 * | 1/2017 | |

* cited by examiner

HEAT EXCHANGER FLANGE PLATE WITH SUPERCOOLING FUNCTION

CROSS-REFERENCE TO RELATED APPLICATIONS

This application claims priority to German Patent Application No. 10 2016 007 089.7 filed Jun. 10, 2016, the entire contents of which are hereby incorporated by reference herein.

TECHNICAL FIELD

The present invention concerns a multi-piece flange plate for a heat exchanger and a heat exchanger with such a multi-piece flange plate.

BACKGROUND

From EP 2 420 763 A2 there is known a refrigerant condenser module having a flange plate, on which a heat exchanger core and a collecting tank are arranged. For a flexible design of the refrigerant condenser module, the flange plate has a multi-piece design, while fluid ducts are formed inside the flange plate, fluidically connecting the heat exchanger core to the collecting tank. One section of the heat exchanger core can be designed in this case as a supercooling section, or another heat exchanger core is arranged on the side of the flange plate opposite the heat exchanger core, serving as a supercooling section.

Usually there is an increasing demand in the case of heat exchangers, especially for the automotive industry, to present the most various configurations with a single design, and the option should also exist to integrate additional components in the heat exchanger in order to satisfy the most diverse requirements for structural space, cooling performance, and connections with the particular application in the installation position. In particular, the heat exchanger should in this case have an integral configuration with at least one additional component, a compact layout, and allow flexible modifications with the most simple of design measures in order to meet the demands of the particular specifications. Furthermore, it is desirable to keep low the number of individual components needing to be modified, so as to reduce the overall number of different individual components within a design, so that the tool costs and installation costs, as well as the associated manufacturing costs, can be reduced.

Furthermore, it is usually attempted to configure the heat exchanger so that the form of the heat exchanger prepared for the integrally bonded assembly has the most compact possible design, so that the space, such as that of the soldering oven, can be utilized optimally during the integrally bonded connection of the individual components.

SUMMARY

The present invention is primarily addressed to the problem of finding an improved or at least an alternative configuration for a flange plate or for a heat exchanger with such a flange plate, which is distinguished in particular by a compact layout and a good flexibility of the fundamental design.

In some embodiments of the invention, a flange plate for a heat exchanger has a heat exchanger core which is configured as a plate stack assembled from a plurality of partial plates stacked on each other, which in the installation position includes at least one upper partial plate facing the heat exchanger core and at least one lower partial plate facing away from the heat exchanger core, wherein the plate stack includes a supercooling passage which is bounded by at least one partial plate in the stacking direction of the partial plates and which receives a flow of refrigerant during the operation of the heat exchanger core.

Advantageously, with such a flexible design in which the supercooling passage of the heat exchanger is formed in the flange plate separate from the heat exchanger core, the supercooling passage can be designed independently of the design of the heat exchanger core. Thus, for example, it is conceivable for the supercooling passage to be larger or smaller in its length and width than the fluid ducts of the heat exchanger core and in addition or alternatively the heat exchanger core and the supercooling passage can be staggered in the stacking direction, so that the fluid ducts of the heat exchanger core and the supercooling passage can overlap only partly or not at all in the stacking direction. Accordingly, the particular specification in regard to the supercooling passage can advantageously be realized independently of the particular design and positioning of the heat exchanger core on the flange plate and this with a flexible positioning of the supercooling passage in the flange plate. Furthermore, despite the design independence of the heat exchanger core, a compact and efficient design can be realized, since no additional components are needed to construct the supercooling passage.

By a flange plate is meant here a plate which is outfitted with fastening elements, such as holes, by means of which the heat exchanger can be attached to other subassemblies. At least one heat exchanger core can be arranged on the flange plate in this case, and can be integrally bonded to the flange plate, for example by brazing or welding. In addition, further components can be secured to the flange plate.

The heat exchange between at least two fluids, such as a refrigerant and a coolant, occurs substantially inside the heat exchanger core. Accordingly, the heat exchanger core includes a plurality of fluid ducts, which succeed each other in the stacking direction of the heat exchanger core and receive a flow of the refrigerant and the coolant, for example in alternation. Accordingly, by the stacking direction of the heat exchanger core is meant the direction in which the fluid ducts succeed each other in the heat exchanger core. The term fluid duct encompasses those ducts of the heat exchanger core in which the fluids flowing through the heat exchanger core stand in heat exchange with each other.

By a refrigerant is meant here a fluid such as, but not limited to, R134a or R1234yf. The refrigerant may occur in two phases in the refrigerant circuit, and in this case it is usually at least partly liquefied in the heat exchanger core, so that a further cooling of the at least partly liquefied refrigerant can occur in the supercooling passage. The refrigerant can be used for example in an air conditioning system for cooling the passenger compartment. In the heat exchanger, the refrigerant stands in thermal contact with a coolant, so that heat can be exchanged between refrigerant and coolant. Usually the refrigerant is cooled by the coolant. If the coolant is a liquid, it is a liquid-liquid heat exchanger and the coolant used may be water, a water-glycol mixture, or the like. But it is also conceivable to use air as the coolant in a gas-liquid heat exchanger. In a typical application, the refrigerant may be under an operating pressure of around 30 bars. The coolant, if in liquid form, can usually be under a pressure of around 3 bars.

The flange plate is made up of a plurality of stacked partial plates and accordingly forms a plate stack. The respective partial plates may also in turn be made up of substantially identically configured plate sections, which then together form in each case a combined partial plate. This can be done when a single-piece partial plate can only be made with great expense, for example on account of the required thickness. Accordingly, the concept of the multi-piece flange plate focuses on the fact that the flange plate is made up of a plurality of partial plates and thus forms a plate stack. The stacking direction runs in this case in relation to the plate stack in the direction of the plate stack or in the direction of the stacked plates.

In order to join the individual partial plates to each other by integral bonding, the partial plates can be formed from a plated material with a braze surface coating. Advantageously, this can dispense with an additional braze in the form of a braze paste or a braze film.

This plate stack is made up at least of an upper partial plate, which faces the heat exchanger core, and at least one lower partial plate, which faces away from the heat exchanger core. By outfitting the partial plates for example with recesses, milled cutouts, embossed indentations or the like and by arranging partial plates in the stacking direction, a material-free space is formed in the plate stack, subtending the supercooling passage. This material-free space is bounded in the stacking direction by at least one partial plate and it is configured so tight in the installation position with the heat exchanger core that it can receive a flow of fluid with no leaks, and during the flow the fluid such as a refrigerant is further cooled down. Accordingly, by a supercooling passage is meant a fluid duct which can bring about a further cooling of a fluid, especially a supercooling of a refrigerant after previous at least partial liquefaction in the heat exchanger core. No other fluid lines formed in the flange plate and designed essentially only to conduct the fluid further in the flange plate are included in the concept of the supercooling passage. As the boundary between a fluid line and a supercooling passage, a surface of a fluid duct in the heat exchanger core which is perpendicular to the stacking direction can be used. The surface of the supercooling passage arranged perpendicular to the stacking direction preferably makes up more than 10%, especially more than 30%, optionally more than 40% and for example more than 50% of the surface of a fluid duct in the heat exchanger core perpendicular to the stacking direction.

Furthermore, the plate stack may additionally have a middle partial plate, which is outfitted with at least one recess forming the supercooling passage.

Advantageously in such an embodiment the height of the supercooling passage in the stacking direction of the plate stack can be defined uniformly and accurately by the middle partial plate and this with no complicated or costly forming process, such as milling, embossing or the like, in which the given tolerances must furthermore be fulfilled. Thanks to the identical base shape of the partial plates, these can be prefabricated from the corresponding semifinished blanks without too much of a variation in their thickness and furthermore using the same tooling, and if the thickness of the partial plates is the same size this can even be done from the same semifinished blank. By means of simple forming processes, such as stamping, the respective lower, upper, and middle partial plates can then be produced from the prefabricated partial plate variants or even from just one partial plate variant. These partial plates are then stacked one on the other to form the plate stack and accordingly the flange plate with its supercooling passage.

Furthermore, the plate stack may have a fluid inlet line for bringing the refrigerant to the supercooling passage.

Advantageously, the flange plate can be furnished in this way with an additional fluid conveying function, besides the function of supercooling of the refrigerant. Accordingly, there is no need for additional components such as pipes, conduits, or the like, by which the refrigerant can be taken to the supercooling passage. Furthermore, the fluid inlet line can be formed in any given shape and position in the flange plate, so that any given requirement in regard to the fluid inlet line and the positioning of the inlet can be realized in flexible manner by minor design measures, such as adapting the middle partial plate.

Furthermore, the plate stack may have a fluid outlet line for taking the refrigerant out from the supercooling passage.

Advantageously, the flange plate can be furnished in this way with an additional fluid conveying function. Accordingly, there is no need for additional components such as pipes, conduits, or the like, by which the refrigerant can be taken away from the supercooling passage. Furthermore, the fluid outlet line can be formed in any given shape and position in the flange plate, so that any given requirement in regard to the fluid outlet line and the positioning of the outlet can be realized in flexible manner by minor design measures, such as adapting the middle partial plate.

Furthermore, the plate stack may have a fluid transfer line for transferring the refrigerant out from the heat exchanger core to another component.

Advantageously, the flange plate can be furnished in this way with an additional fluid conveying function, making it possible to connect another component to the flange plate which can be supplied with refrigerant through the flange plate. Since this fluid transfer function can also be configured in any given form in the flange plate, the flexible positioning of an additional component on the flange plate can be realized with no major design measures and without the need for additional components.

By such fluid lines is meant material-free spaces in the flange plate, such as ducts, recesses, cavities or the like, which can receive a flow of the refrigerant so that the refrigerant can be taken to the particular section of the heat exchanger or away from the particular section.

Advantageously, thanks to the fluid lines arranged in the plate stack, a high flexibility in regard to the connections and positioning of additional components can be achieved by minor changes of the plate stack and independently of the design used for the heat exchanger core. Thus, any given configuration of the plate stack can be achieved with the most simple of design steps, as need be.

Furthermore, the plate stack may have at least one external inlet opening for connecting of a refrigerant inlet to the heat exchanger.

Advantageously, the inlet for the refrigerant can be positioned in any desired place on the flange plate, so that the heat exchanger can be supplied via the flange plate with refrigerant in concert with a fluid inlet line, for example.

Furthermore, the plate stack may have an external outlet opening for connecting of a refrigerant outlet of the heat exchanger.

Also advantageously in this case the outlet for the refrigerant can be positioned in any desired place on the flange plate, so that the refrigerant can be taken away from the heat exchanger in concert with a fluid outlet line, for example.

Furthermore, the plate stack may have an internal outlet opening for connecting of a refrigerant inlet of another component.

Advantageously, refrigerant can be supplied via the flange plate through the plate stack by way of the internal outlet opening to another component. In this case as well, the outlet opening can be positioned flexibly on the flange plate, so that a high flexibility in the arrangement of the additional component is made possible.

Furthermore, the plate stack may have an internal inlet opening for connecting of a refrigerant outlet of another component.

Also advantageously in this case refrigerant can be taken from another component via the flange plate to the heat exchanger core, while the positioning of the internal inlet opening flexibly on the flange plate can be done so that a high flexibility is assured in regard to the positioning of the additional component on the flange plate.

Furthermore, the internal inlet opening and the external outlet opening can be arranged diagonally with respect to the supercooling passage. Advantageously, in this way a diagonal flow of refrigerant through the supercooling passage can be achieved, so that sufficiently good heat exchange performance can be achieved.

Furthermore, at least one opening chosen from the group of external inlet opening, external outlet opening, internal outlet opening, and internal inlet opening can be arranged on the side facing the heat exchanger core or on the side facing away from the heat exchanger core.

Advantageously, thanks to the option of arrangement on both sides of the flange plate, an additional flexibility may be achieved. Thus, for example, when arranging an opening on the side of the heat exchanger core facing away from the heat exchanger core the latter can be supplied with refrigerant directly from another component group by connecting the flange plate to the additional component group.

By the facing side or the facing away side is meant here the side of the flange plate to which the heat exchanger core is connected by integrally bonded connection or the side opposite to this, respectively.

At least one opening can in this case be outfitted with a connection element designed as a connection pipe.

Advantageously, such a connection pipe can be connected fluidically to another component by an integrally bonded connection. This is done, for example, by brazing or welding of the other component to the connection pipe.

Furthermore, at least one opening can be outfitted with a connection element designed as a plug connection.

In this plug connection, advantageously an additional component can be connected fluidically to the flange plate by plugging in. Such plug-in additional components can be mounted after the integrally bonded assembly of the heat exchanger, so that advantageously the space is reduced which is occupied by the heat exchanger ready for the integrally bonded assembly. In this way, the space can be used more efficiently, for example in a brazing furnace. Such a later mounting of components also advantageously reduces the complexity of a fixation jig by which the components of the heat exchanger are secured to each other prior to the integrally bonded assembly, so that for example a brazing can be done in a brazing furnace with lower reject rate. Furthermore, during servicing the additional components may be replaced simply by loosening the plug connection. Moreover, because of the interchangeability, it is advantageously possible to use standard components available on the market, sometimes in large numbers, which can be substituted for one another according to availability in order to avoid production bottlenecks.

The plug connection can in this case additionally have a fastening device by which an unintentional loosening of the plug connection can be prevented advantageously.

Furthermore, at least one opening can be outfitted with a connection element designed as a bayonet connection. Advantageously, an additional component can be fluidically connected very easily by a bayonet connection to the flange plate and this after the integrally bonded assembly of the heat exchanger, so that a later mounting or dismounting is made possible.

The bayonet connection may in this case be outfitted with a twist preventer, so that an unintentional loosening of the bayonet connection can be prevented.

Furthermore, at least one opening can be outfitted with a connection element designed as a screw connection, so that the aforementioned advantages can be achieved at least in part.

Furthermore, at least one opening can be outfitted with a connection element designed as a flange connection. Advantageously, an additional component can be fluidically connected to the flange plate likewise by means of the flange connection after the integrally bonded assembly of the heat exchanger, and in this case a later dismounting of the additional component is made possible.

Furthermore, the respective connection elements arranged at the openings can be attached to the plate stack by integral bounding, for example by brazing or welding, so that the connection elements can be attached to the openings at the same time as the integrally bonded assembly of the heat exchanger.

The additional component may in this case be an intake line or a drain line, possibly designed as a pipe, a collecting device, a drying device, or a combined collecting and drying device.

Furthermore, a flow-guiding insert can be installed in the supercooling passage, especially a turbulence-producing insert.

Advantageously, the heat exchange between the supercooling passage and the surroundings or another fluid duct can be improved by the use of such an insert in the supercooling passage, so that the refrigerant can be sufficiently further cooled by the supercooling passage.

Such a flow-guiding insert can, for example, be fins, whose walls may be perforated, and/or which can be provided with ribs, gills, or the like.

In another aspect of the invention, a heat exchanger is proposed with a flange plate, as described above.

Advantageously, when such a flange plate is used, regardless of the design of the heat exchanger the supercooling passage can be configured as required, without having to take this into account in the design of the heat exchanger. Furthermore, a high flexibility can be achieved in the arrangement of the heat exchanger and additional components on the flange plate, since the flange plate can be outfitted with fluid ducts which enables a flexible positioning of the heat exchanger core and additional components on the flange plate. Basically, any of the benefits described above can be achieved.

Furthermore, the fluid duct of the heat exchanger core which is immediately adjacent to the flange plate can receive a flow of coolant. Advantageously, the heat exchange between the refrigerant flowing in the supercooling passage and the coolant flowing in the immediately adjacent fluid duct can be achieved in this way, so that an adequate further cooling or supercooling of the refrigerant by the coolant flowing in the heat exchanger can be achieved.

By immediately adjacent fluid duct is meant here that fluid duct in the heat exchanger which is arranged directly adjacent to the supercooling passage in the flange plate.

Furthermore, an additional component can be arranged in the flow direction of the refrigerant upstream from the supercooling passage after the heat exchanger core. Advantageously, an additional component can be arranged in this way between the heat exchanger core and the supercooling passage, which can furthermore be arranged flexibly on the flange plate.

By flow direction of the refrigerant is meant here that direction in which the refrigerant flows through the heat exchanger within the fluid duct or through the additional components. The same holds for the flow direction of the coolant.

Furthermore, the additional component can be a collecting device for the stockpiling of the refrigerant or a drying device for the drying of the refrigerant or a collecting and drying device for the stockpiling and drying of the refrigerant. Advantageously, by the use of such devices, the refrigerant can be stockpiled and/or dried by the heat exchanger, so that the high integral design can achieve an extremely compact layout also in terms of the functions implemented.

By a collecting device is meant here a collector, a tank, a bottle or the like in which, when drying agent is installed, the refrigerant in addition to being stockpiled can also be dried. During the operation of the heat exchanger, the refrigerant flows through such a device, whereupon the refrigerant can become dried. If the device is adequately dimensioned, the refrigerant can also be stockpiled by the device.

Furthermore, the connection region in which the heat exchanger core is integrally bonded to the flange plate and the region of the supercooling passage may have an overlapping of the two regions at least for a portion.

Advantageously in this way the heat exchanger core can even be arranged flexibly outside the supercooling passage, so that a high flexibility can be achieved in regard to the arrangement of the heat exchanger core on the flange plate. If a further overlapping is still present, as in this case, the refrigerant flowing in the supercooling passage can be further cooled at least for a portion by the heat exchanger and optionally by the cooling fluid flowing in the heat exchanger.

Furthermore, the connection region in which the heat exchanger core is integrally bonded to the flange plate and the region of the supercooling passage can be designed so that the region of the supercooling passage is arranged inside the connection region.

Advantageously, a sufficiently good further cooling or supercooling of the refrigerant by the heat exchanger or by the coolant flowing therein can be accomplished in this way, since the entire supercooling passage is arranged inside the connection region in regard to the flange plate and thus it is surrounded by same along the flange plate.

Furthermore, the connection region in which the heat exchanger core is integrally bonded to the flange plate and the region of the supercooling passage can be designed so that the connection region is arranged in the region of the supercooling passage.

Advantageously, it can be ensured in this way that the refrigerant can be brought from the heat exchanger into the supercooling passage with no further need for fluid lines, and this with no design change to the heat exchanger core, since the entire connection region along the flange plate is surrounded by the region of the supercooling passage in regard to the flange plate. Thus, it is ensured that the refrigerant gets directly into the supercooling passage in any given positioning of the refrigerant outlet on the side of the heat exchanger facing the flange plate.

By connection region is meant here the region or contact zone on the flange plate in which the heat exchanger core is integrally bonded to the flange plate, or has contact with it. Thus, the connection region subtends an area on the flange plate. The supercooling passage in this case likewise subtends in imaginary manner an area on the flange plate, so that the two areas subtended on the flange plate may be compared in regard to an overlapping or arrangement relative to each other. Consequently, by an overlapping for a portion is meant that the particular regions in question have a common intersection surface, whereas for a relative arrangement the one surface is arranged inside the other.

Furthermore, the upper partial plate can have at least one recess which is arranged inside the connection region.

Advantageously, thanks to such a recess on the upper partial plate a direct contact of the supercooling passage with the heat exchanger core can be produced. Thanks to the recess in the upper partial plate, the supercooling passage is now bounded in this case in the stacking direction by the heat exchanger core. In this way, on the one hand, material can be saved advantageously, and on the other hand the supercooling passage can be enlarged by the recess. Furthermore, thanks to the recess the supercooling passage stands directly in contact with the heat exchanger core, so that the heat exchange can be improved by the direct contact.

Furthermore, the upper partial plate can have at least one recess which is arranged inside the region of the supercooling passage.

Advantageously, thanks to such a design of the recess, the heat exchanger core can act as a boundary to the supercooling passage in the stacking direction, and furthermore a supercooling passage can be formed which is larger than the heat exchanger core or the connection region.

By recess is meant here an opening in the upper partial plate which is covered by the heat exchanger core in the installed position with the latter, so that a sealing of the supercooling passage by the heat exchanger core, among others, is produced. If several recesses are formed, they may form a perforation structure.

Furthermore, the heat exchanger core can be configured in stack design.

By stack design is meant here that the flat tubes forming the heat exchanger core are stacked in a direction, the stacking direction, while between the flat tubes there are formed fluid ducts for at least one fluid and in the flat tubes there are formed fluid ducts for at least one other fluid.

Furthermore, the heat exchanger core can be configured in shell design.

By shell design is meant here that the heat exchanger is formed by shells which are stacked one on another, while between the shells there are formed fluid ducts which receive a flow of a refrigerant and a coolant, for example in alternating manner in the stacking direction.

Furthermore, the heat exchanger core can be configured as a liquid-liquid heat exchanger, so that a liquid refrigerant or a two-phase refrigerant occurring in at least a portion in the refrigerant circuit stands in heat exchange with a liquid coolant, while thanks to the cooling of the refrigerant in the heat exchanger the latter can be at least partially liquefied.

Furthermore, the heat exchanger core can be configured as a multiflow heat exchanger. Such a multiflow heat exchanger can be outfitted with several flow sections in the stacking direction of the heat exchanger, having one or more fluid ducts, while neighboring flow sections may have an opposite macroscopic flow direction of the refrigerant. The respective flow sections may have a decreasing number of fluid passages in the flow direction of the refrigerant.

By macroscopic flow direction of the refrigerant is meant here the direction of flow of the refrigerant through the heat exchanger regardless of the microscopic flow directions, which may come into being for example through turbulence, flow guiding elements, or the like.

Furthermore, the heat exchanger core can be designed as a condenser, wherein a refrigerant which flows into the heat exchanger at least partly in gaseous form is liquefied at least partly by the heat exchanger or condenser.

DETAILED DESCRIPTION

Before any embodiments of the invention are explained in detail, it is to be understood that the invention is not limited in its application to the details of construction and the arrangement of components set forth in the following description or illustrated in the accompanying drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
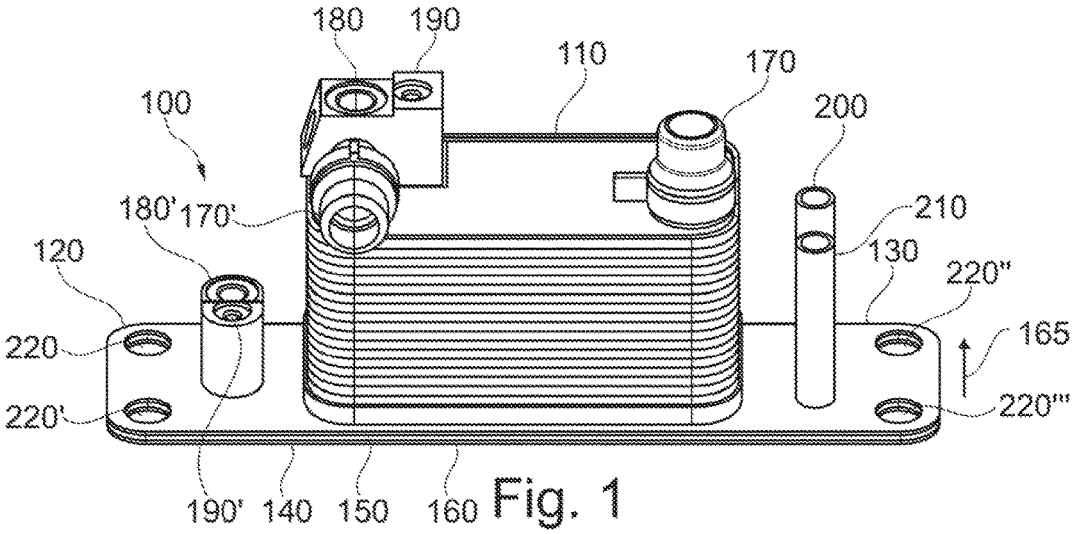
FIG. 1 is a perspective view of a heat exchanger with a flange plate constructed as a plate stack, according to an embodiment of the invention.

A heat exchanger 100, as shown in FIG. 1, has a heat exchanger core 110 and a flange plate 120. The flange plate 120 is in this case designed as a plate stack 130, which has a plurality of partial plates 140, 150, 160 stacked one on another. The partial plates 140, 150, 160 are arranged in this case in the stacking direction 165, i.e., in the direction of the heat exchanger core 110. The plate stack 130 may in this case have an upper partial plate 140, a middle partial plate 150 and a lower partial plate 160. But it is also conceivable for the plate stack 130 to have only one upper partial plate 140 and one lower partial plate 160. The heat exchanger core 110 can be outfitted with coolant ports 170, 170', by which the coolant can be supplied to and drained from the heat exchanger core 110.

Furthermore, the heat exchanger core 110 can be outfitted with a connection element 180 configured as a plug connection 180, into which a refrigerant supply line (not shown) can be plugged, so that the refrigerant can be supplied to the heat exchanger core 110. Such a plug connection 180 can be outfitted with a fastening device 190, by means of which an additional component (not shown) plugged into the plug connection 180 can be fastened to the plug connection 180, so that an unintentional loosening from the plug connection 180 is prevented.

Furthermore, an additional plug connection 180' can be arranged on the flange plate 120, in which a refrigerant drain line (not shown) can be inserted, so that the refrigerant can be transported away from the heat exchanger 100. This plug connection 180' can likewise be outfitted with a fastening device 190'.

It is also conceivable to arrange another plug connection, not shown, on the flange plate 120, in which a refrigerant supply line, also not shown, can be inserted, so that in departure from the design of the heat exchanger core 100 shown in FIG. 1, it is supplied with refrigerant indirectly via the flange plate 120. This plug connection can likewise be outfitted with a fastening device.

It is also conceivable to use other connection elements, not shown, such as screw connections, flange connections, bayonet connections or the like.

For the attachment of an additional component to the heat exchanger 100, the flange plate 120 may have for example a drain connection pipe 200 for connecting a refrigerant inlet of an additional component not shown and/or a supply connection pipe 210 for connecting a refrigerant outlet of an additional component not shown. An additional component may be attached to these connection pipes 200, 210, for example by integral bonding.

Furthermore, the flange plate 120 may have one or more fastening elements 220,220',220",220''' such as holes, recesses, connecting pins, union nuts, threads, or the like, by which the heat exchanger 100 can be secured to another subassembly.

Figure 2:
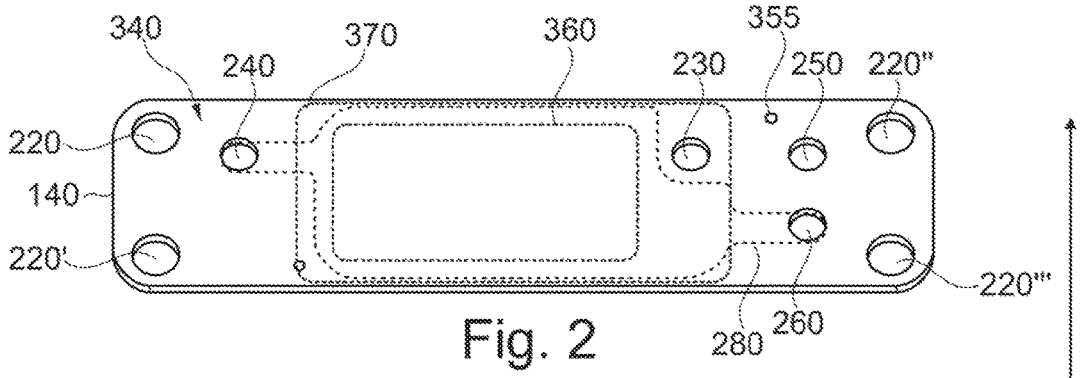
FIG. 2 is a perspective view of an upper partial plate of the plate stack of FIG. 1.

The upper partial plate 140, as shown in FIG. 2, may have several openings 230, 240, 250, 260, by which the refrigerant can be taken to or from the flange plate 120. Thus, the upper partial plate 140 can have a connection opening 230 by which the refrigerant arriving from the heat exchanger core 110 can enter the flange plate 120. If the refrigerant drain is provided on the flange plate 120, the flange plate 120 can be outfitted with an external outlet opening 240, by which a fluidic connection can be made, for example, through a plug connection 180', as shown in FIG. 1. It is likewise conceivable to position on the upper partial plate 140 an external inlet opening, not shown, for connecting a refrigerant inlet to the heat exchanger, so that contrary to the embodiment shown in FIGS. 1, 2, 3, 4, the refrigerant supply to the heat exchanger 100 is done via the flange plate 120. For this, a connection element similar to the plug connection 180' can likewise be arranged on the flange plate at the external inlet opening formed in the flange plate 120.

If another component, not shown in FIGS. 1, 2, 3, 4, is attached directly to the flange plate 120 and supplied with refrigerant through this, the upper partial plate 140 can have an internal outlet opening 250 by which a refrigerant supply of another component can be attached. If the refrigerant is to be returned from the additional component back to the heat exchanger 100, the flange plate 120 can have an internal inlet opening 260 by which the refrigerant can be taken from the additional component back to the flange plate 120 once again.

Figure 3:
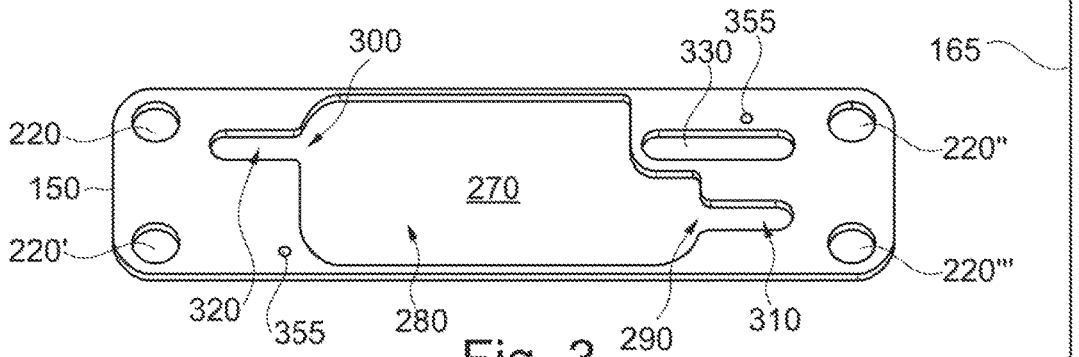
FIG. 3 is a perspective view of a middle partial plate of the plate stack of FIG. 1.

If a middle partial plate 150 is used, as shown in FIG. 3, the middle partial plate 150 can have a recess 270, forming a supercooling passage 280 in the plate stack 130 or in the flange plate 120 in the installed position with the other partial plates 140, 160. In this supercooling passage 280, the refrigerant can flow from an inlet region 290 of the supercooling passage 280 to an outlet region 300 of the supercooling passage 280 and become further cooled or supercooled in this process. If, in this case, the inlet region 290 and the outlet region 300 are arranged diagonally in regard to the supercooling passage 280, the flow through the supercooling passage 280 and the resulting heat exchange may be advantageously improved. In this case, as shown in FIG. 2, the internal inlet opening 260 and the external outlet opening 240 are also arranged diagonally on the upper partial plate 140 relative to the supercooling passage 280.

In order to guide the refrigerant into the inlet region 290, the middle partial plate 150 can have another recess, which forms, in the installed position, a fluid inlet line 310 for supplying the refrigerant to the supercooling passage 280. This fluid inlet line 310 can be formed as an elongated hole or have any desired shape, so that the corresponding internal inlet opening 260 can be arranged in any desired place in the flange plate 120 or the upper partial plate 140.

Now, in order to guide the refrigerant from the supercooling passage 280 to the external outlet opening 240, the middle partial plate 150 can have another recess, which forms in the installed position a fluid outlet line 320 in the plate stack 130 by which the refrigerant can be taken away from the supercooling passage 280. This fluid outlet line 320 can likewise have any desired shape and, for example, it can be designed as an elongated hole, so that the external outlet opening 240 in the upper partial plate 140 can be positioned in any desired place on the flange plate 120.

Furthermore, the middle partial plate 150 can have another recess, which forms a fluid transfer line 330 in the plate stack 130, by which the refrigerant can be transferred away from the heat exchanger core 110 to another component. Corresponding to the fluid transfer line 330 are arranged the connection opening 230 and the internal outlet opening 250 in the upper partial plate 140, so that the refrigerant coming from the heat exchanger core 110 can be guided across the flange plate 120 to a further component. This fluid transfer line 330 can also be made in any desired shape by simple design measures.

If no such middle partial plate 150 is provided, the aforementioned structures of the middle partial plate 150 can also be formed in a lower partial plate 160 or in the upper partial plate 140, for example, by milling or some other forming technique.

Figure 4:
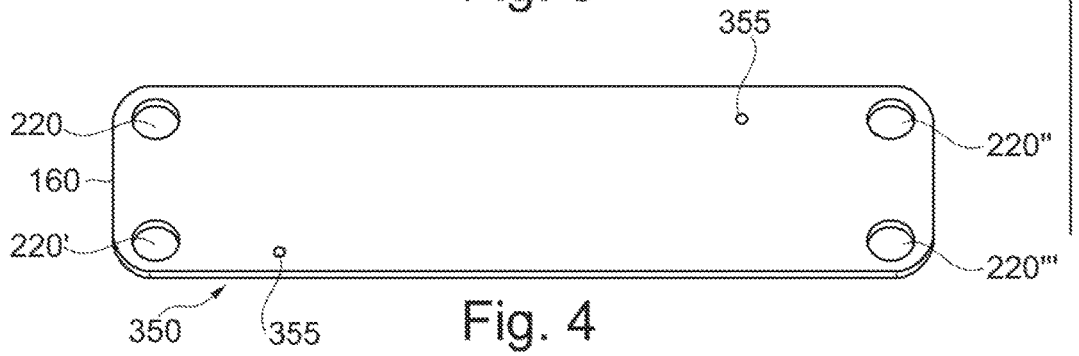
FIG. 4 is a perspective view of a lower partial plate of the plate stack of FIG. 1.

The lower partial plate 160 when a middle partial plate 150 is present can be formed as shown in FIG. 4 and is outfitted as a pure plate with fastening elements 220, 220', 220", 220'''. It is also conceivable, for example, that the external outlet opening 240 and/or the external inlet opening are formed not on the upper partial plate 140 or the heat exchanger core 110, but instead on the lower partial plate 160. Consequently, by connecting the flange plate 120 to another subassembly, not shown, via the flange plate 120 or via the lower partial plate 160, the refrigerant can be taken away from the heat exchanger 100 or brought to the heat exchanger 100.

In theory, any opening by which refrigerant or coolant can be taken to or away from the heat exchanger core 110 or taken to or away from the heat exchanger 100 can be arranged on a side 340 facing the heat exchanger core 110 or on a side 350 facing away from the heat exchanger core 110. Consequently, such openings can be formed on the lower partial plate 160 and consequently on the side 350 facing away or on the upper partial plate 140 and consequently on the facing side 340, as desired or as need be.

As is shown by FIGS. 2, 3, 4, the partial plates 140, 150, 160 can be outfitted with positioning elements 355 by means of which the partial plates 140, 150, 160 can be precisely stacked on one another during prefabrication. Such positioning elements 355 can be formed as bulges, dimples, embossings, recesses or the like.

By virtue of the partial plates 140, 150, 160 stacked on one another, the supercooling passage 280 is bounded by at least one partial plate, specifically the lower partial plate 160, in the stacking direction 165 of the plate stack 130. If the upper partial plate 140 is likewise formed with a complete surface except for the openings 230, 240, 250, 260, the supercooling passage 280 will likewise be bounded in the stacking direction by the upper partial plate 140.

But it is also conceivable, as indicated in FIG. 2, to make a recess 360 in the upper partial plate 140 in the region of the supercooling passage 280, so that the supercooling passage 280 stands directly in contact with the heat exchanger core 110. In this case, such a recess 360, which can optionally be provided in the upper partial plate 140, on the one hand can save on material and, on the other hand, can improve the thermal contact between the heat exchanger core 110 and the supercooling passage 280.

Finally, such a recess 360 may be designed about as large as a connection region 370, in which the heat exchanger core 110 is integrally bonded to the flange plate 120. Preferably, the recess 360 is smaller than the connection region 370, so that a sufficiently stable integrally bonded connection of the heat exchanger core 110 to the upper partial plate 140 can still be produced.

Figure 5:
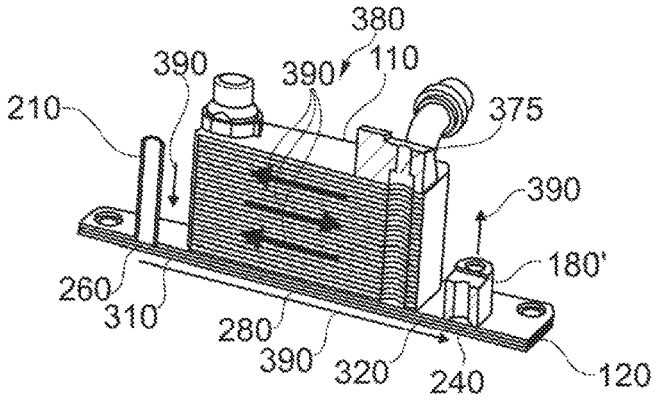
FIG. 5 is a perspective view showing a diagonal section through a supercooling passage of the heat exchanger of FIG. 1.
Figure 6:
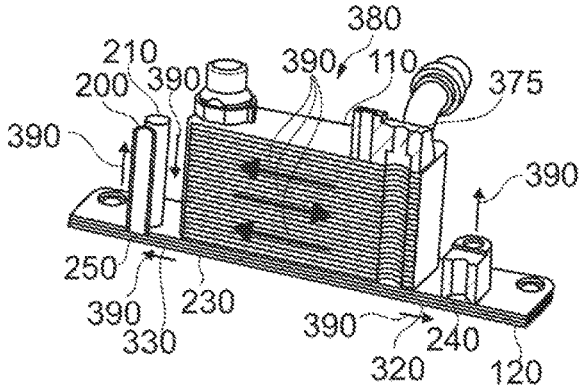
FIG. 6 is a perspective view showing a section through two refrigerant manifolds of the heat exchanger of FIG. 1.

The heat exchanger core 110, as shown in FIG. 5, can be formed as a multi-flow heat exchanger 380. In the embodiment depicted, the refrigerant is supplied via an external inlet opening 375 to the heat exchanger core 110. Inside the heat exchanger core 110, a flow direction 390 of the refrigerant undergoes one or more diversions until it is taken, as shown in FIG. 6, via the connection opening 230 in the fluid transfer line 330 to the internal outlet opening 250 inside the plate stack 130. From there, the refrigerant can be taken, for example, by a drain connection pipe 200 to another component and then from the other component via a supply connection pipe 210 to the internal inlet opening 260, as shown in FIG. 5. From the internal inlet opening 260, the refrigerant can flow into the fluid inlet line 310 and move diagonally in the flow direction 390 through the supercooling passage 280. From the supercooling passage 280, the refrigerant can be taken via the fluid outlet line 320 to the external outlet opening 240 and emerge from the heat exchanger 100.

Figure 7:
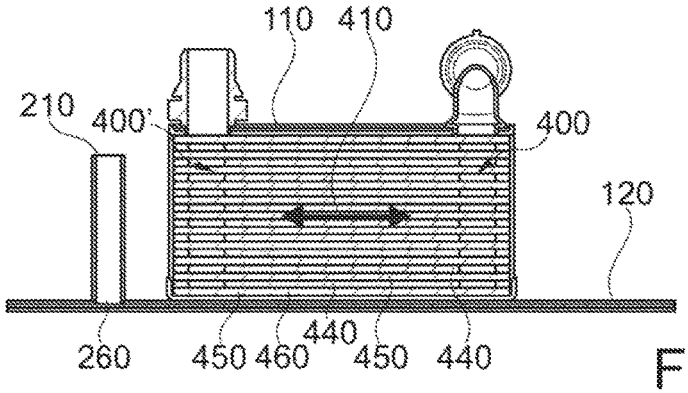
FIG. 7 is a side view showing a section through two coolant manifolds of the heat exchanger of FIG. 1.

As shown in FIG. 7, the supply connection pipe 210 or the internal inlet opening 260 can be arranged in the line of intersection of the two coolant manifolds 400, 400', while the heat exchanger core 110 can be designed as a single-flow or a multi-flow variant in regard to the flow direction 410 of the coolant.

Figure 8:
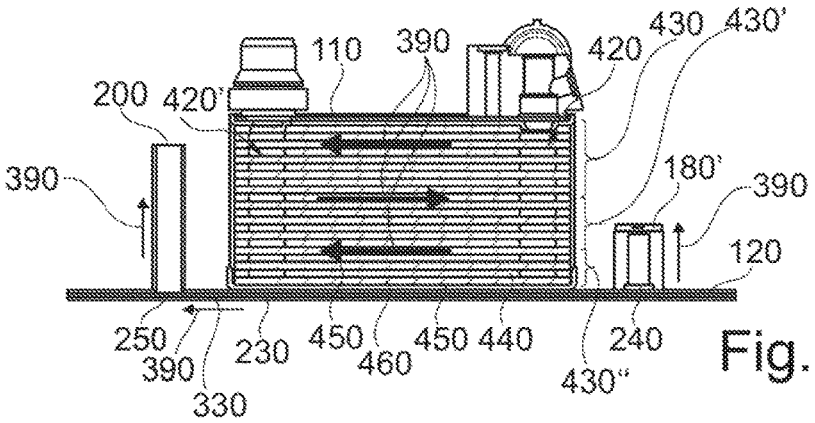
FIG. 8 is a side view showing a section through two refrigerant manifolds of the heat exchanger of FIG. 1.

As shown in FIG. 8, in the heat exchanger core 110 designed as a multi-flow heat exchanger 380, the refrigerant can flow back and forth between the two refrigerant manifolds 420, 420' inside flow sections 430, 430', 430". The flow sections 430, 430', 430" may in this case have one or more fluid ducts 440 for the refrigerant. These fluid ducts 440 of the refrigerant stand in heat exchange with fluid ducts 450 of the coolant, while a fluid duct 460 of the heat exchanger core 110 immediately adjacent to the flange plate 120 preferably receives the flow of coolant.

As shown in FIG. 8, the drain connection pipe 200 or the internal outlet opening 250 and the external outlet opening 240 can be arranged in the intersection of the refrigerant manifolds 420, 420' on the flange plate 120.

Figure 9:
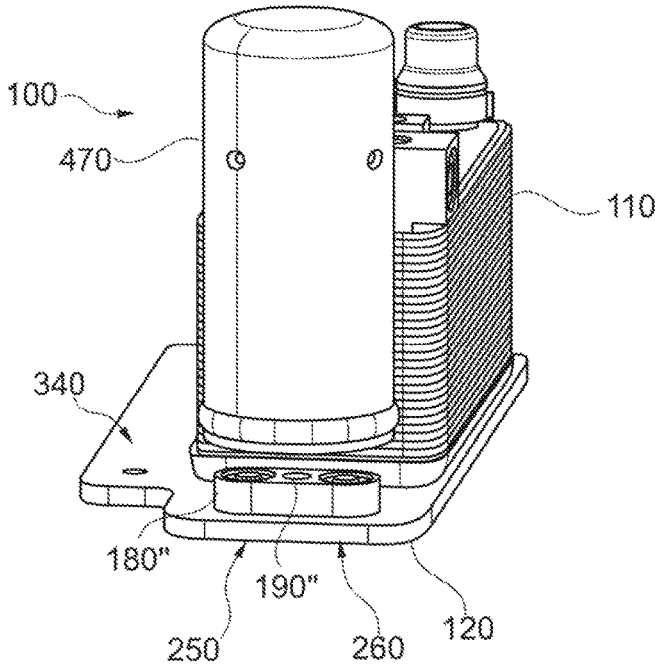
FIG. 9 is a perspective view of a heat exchanger with a dismounted collection and drying device, according to an embodiment of the invention.

FIG. 9 shows a heat exchanger 100 having a flange plate 120 on which is arranged a heat exchanger core 110 and a collecting device 470 as a further component. The collecting device 470 here can be provided with a drying function, so that the collecting device 470 is also designed as a collecting and drying device. Now, if the internal outlet opening 250 and the internal inlet opening 260 are provided with an integral plug connection 180", the collecting device 470 can be inserted into the plug connection 180" and be mounted by means of the fastening device 190" on the flange plate 120.

Figure 10:
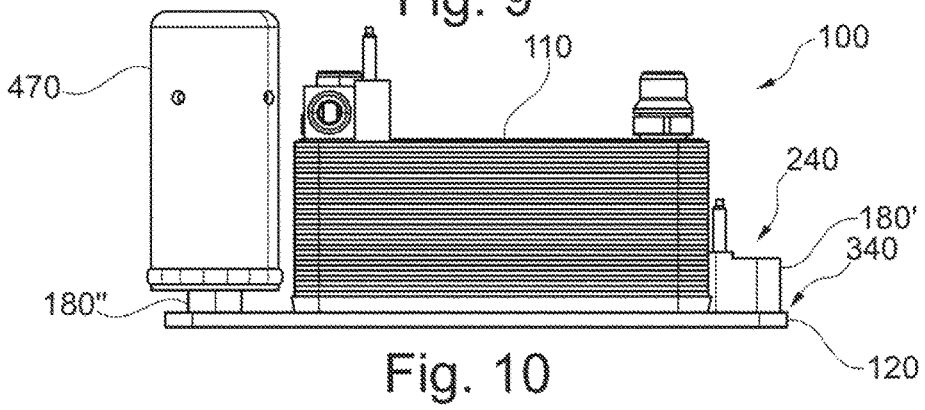
FIG. 10 is a side view of the heat exchanger of FIG. 9, with the collection and drying device in the installed position.

Such an integrated embodiment of heat exchanger 100 with collecting device 470 has the advantage that the standard collectors 470 available on the market in sufficient numbers can be used, being retrofitted after the integrally bonded assembly of the heat exchanger 100, so that the integrally bonded assembly, such as the brazing of the heat exchanger 100 can be done more efficiently without collecting device 470, as an available space in a brazing furnace can be better utilized. Furthermore, the external outlet opening 240, as shown in FIG. 10, can be arranged on the side 340 facing the heat exchanger core 110 and optionally be outfitted with a plug device 180'.

Figure 11:
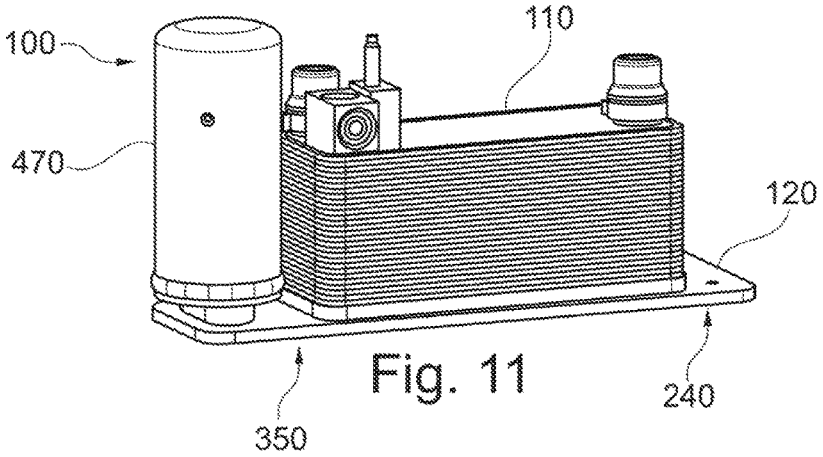
FIG. 11 is a perspective view of the heat exchanger of FIG. 9, with the collection and drying device in the installed position.

It is also conceivable, as shown in FIG. 11, to arrange the external outlet opening 240 on the side 350 of the flange plate 120 facing away from the heat exchanger core 110. In this way, the refrigerant can be supplied from the heat exchanger 100 to another subassembly via the flange plate 120 and via the external outlet opening 240 formed in the flange plate 120 on the side 350 facing away.

Figure 12:
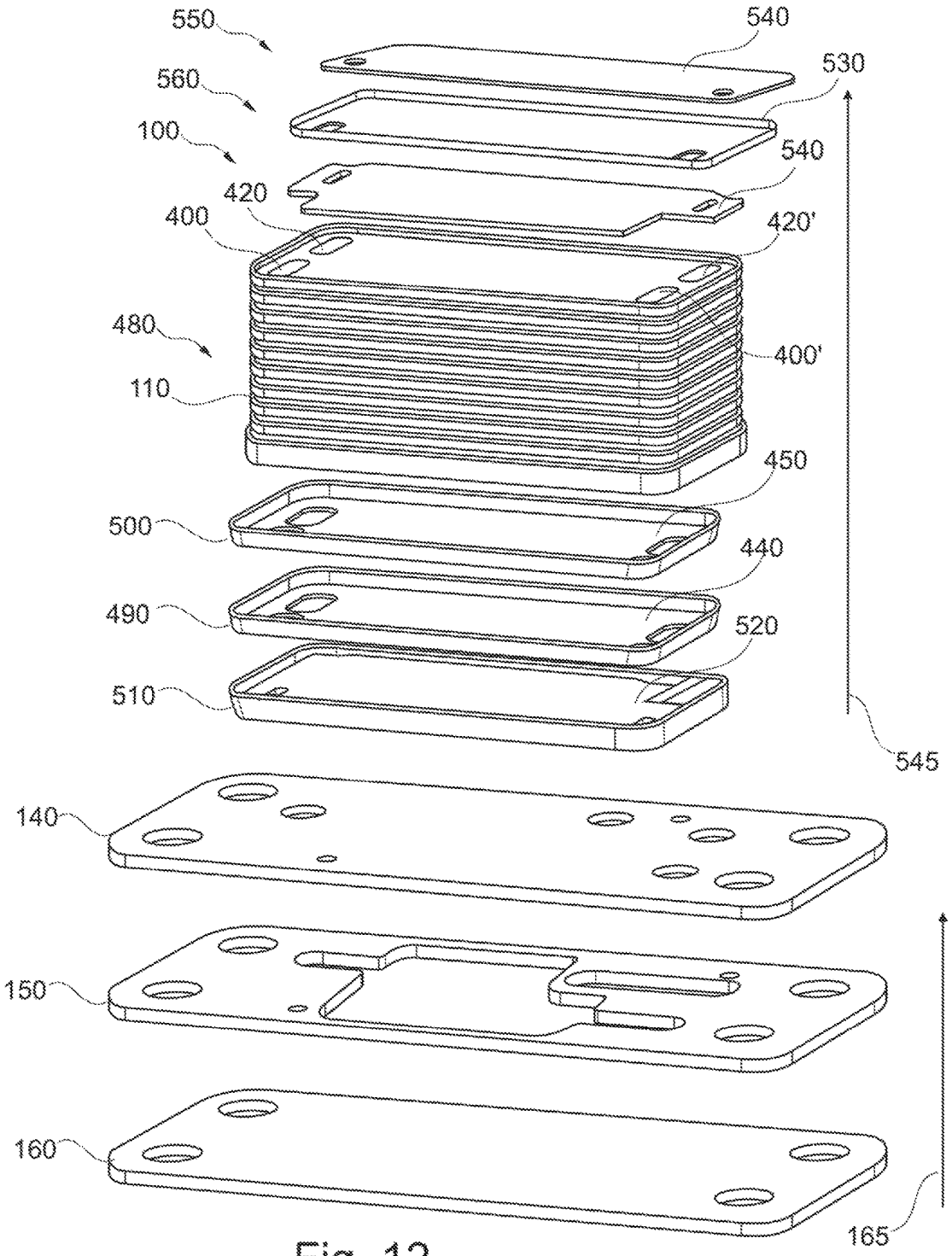
FIG. 12 is an exploded perspective view of a shell design heat exchanger with multi-piece flange plate, according to some embodiments of the invention.

If the heat exchanger 100, or the heat exchanger core 110, is in a stack design 480, as shown in FIG. 12, the heat exchanger core 110 will have a plurality of pipe shells 490, 500. These pipe shells 490, 500 are nested in one another and thanks to being mutually spaced apart they form fluid ducts 440 for the refrigerant and fluid ducts 450 for the coolant. Flow-guiding inserts (not shown) can be installed in the fluid ducts 440 for the refrigerant and/or in the fluid ducts 450 for the coolant, especially turbulence-generating inserts. In addition or alternatively, the pipe shells 240, 240' can be provided with dimple-shaped bulges, not shown, which on the one hand serve as a bracing against the following pipe shells 490, 500 and, on the other hand, can form microscopic fluid ducts in the fluid ducts 440, 450.

Furthermore, the heat exchanger core 110 is also outfitted with the end-side flange plate 120, which is connected by integral bonding to a base pipe shell 510, especially by soldering and/or welding, in which for purposes of boosted performance, a flow-guiding insert 520 may be installed, and afterwards a normal pipe shell 490, 500 is inserted into this. On the side opposite the flange plate 120, the heat exchanger 100 may have a flow-guiding insert 520 installed in the last normal pipe shell 490, 500. The last normal pipe shell 490, 500 can be closed off by an end pipe shell 530 and/or by an end tube plate 540.

The fluid ducts 440 for the refrigerant can in this case be supplied with refrigerant via the refrigerant manifolds 420, 420' formed from the pipe shells 490, 500, while the fluid ducts 450 for the coolant can be supplied with coolant via the coolant manifolds 400, 400' formed from the pipe shells 490, 500. The pipe shells 490, 500 are in this case nested in one another in the stacking direction 545 of the heat exchanger core 110.

Such a heat exchanger 100 can be designed as a liquid-liquid heat exchanger 550 or as a condenser 560, where the fluid ducts 440 for example receive a flow of a refrigerant such as R134, and the fluid ducts 450 receive a flow of coolant such as a water-glycol mixture.

Various alternatives to the certain features and elements of the present invention are described with reference to specific embodiments of the present invention. With the exception of features, elements, and manners of operation that are mutually exclusive of or are inconsistent with each embodiment described above, it should be noted that the alternative features, elements, and manners of operation described with reference to one particular embodiment are applicable to the other embodiments.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention.

What is claimed is:

1. A heat exchanger comprising:

a heat exchanger core configured as a stack of plates, alternating ducts for a flow of refrigerant and a flow of a liquid coolant defined between adjacent ones of the plates;

a flange plate joined to a lowermost plate of the stack of plates, the flange plate comprising an upper plate facing the heat exchanger core to which the lowermost plate of the stack of plates is joined, and a lower plate facing away from the heat exchanger core, wherein a connection region is defined as that portion of the upper plate where the lowermost plate of the stack of plates is joined to the upper plate; and a supercooling passage for the flow of refrigerant arranged within the flange plate and bounded by at least one of the upper and lower plates of the flange plate, the supercooling passage extending directly below the heat exchanger core to allow for the transfer of heat between refrigerant passing through the supercooling passage and liquid coolant passing through that duct of the heat exchanger core bounded by said lowermost plate of the stack of plates, wherein the flange plate further comprises: a first refrigerant inlet, arranged in the upper plate within the connection region; a first refrigerant outlet arranged outside of the connection region; a fluid transfer line extending between the first refrigerant inlet and the first refrigerant outlet; a second refrigerant inlet arranged outside of the connection region and fluidly connected to the supercooling passage; and a second refrigerant outlet arranged outside of the connection region and fluidly connected to the supercooling passage.

2. The heat exchanger of claim 1, wherein the second refrigerant inlet and the second refrigerant outlet are diagonally arranged with respect to the supercooling passage.

3. The heat exchanger of claim 1, further comprising a collecting device coupled to the flange plate to receive a flow of refrigerant from the flange plate by way of the first refrigerant outlet and to deliver a flow of refrigerant to the flange plate by way of the second refrigerant inlet.

4. The heat exchanger of claim 3, wherein the collecting device is removably coupled to the flange plate.

5. The heat exchanger of claim 1, wherein the first refrigerant inlet is fluidly coupled to a refrigerant manifold provided within the heat exchanger core.

6. The heat exchanger of claim 1, further comprising a plug connection joined to the flange plate, the plug connection providing fluid access from and to the first refrigerant outlet port and the second refrigerant inlet port.

7. The heat exchanger of claim 1, further comprising a flow-guiding insert arranged within the supercooling passage.

8. The heat exchanger of claim 7, wherein the flow-guiding insert is a turbulence-producing insert.

9. The heat exchanger of claim 1, wherein the supercooling passage is bounded by a surface located between the supercooling passage and the heat exchanger core and arranged perpendicular to a stacking direction of the stack of plates, and wherein said surface covers more than 10% of that duct of the heat exchanger core bounded by the lowermost plate of the stack of plates.

10. The heat exchanger of claim 9, wherein said surface covers more than 30% of that duct of the heat exchanger core bounded by the lowermost plate of the stack of plates.

11. The heat exchanger of claim 9, wherein said surface covers more than 50% of that duct of the heat exchanger core bounded by the lowermost plate of the stack of plates.

12. The heat exchanger of claim 9, wherein said surface is provided by the lowermost plate of the stack of plates.

13. The heat exchanger of claim 1, wherein the flange plate further comprises a middle plate arranged between the upper and lower plates, the middle plate having a recess to at least partially define the subcooling passage.

14. The heat exchanger of claim 1, wherein the upper plate is provided with a recess directly underneath the core so that refrigerant passing through the supercooling passage is able to directly contact the lowermost plate of the stack of plates.

15. The heat exchanger of claim 14, wherein the recess is located within the connection region by which the heat exchanger core is joined to the flange plate.

* * * * *